US005101521A

United States Patent [19]

Levien

[11] Patent Number: 5,101,521

[45] Date of Patent: Apr. 7, 1992

[54] BATHTUB ASSEMBLY HAVING CONTOURED WALLS AND ACCESSORIES

[75] Inventor: Robin H. Levien, London, England

[73] Assignee: American Standard Inc., New York, N.Y.

[21] Appl. No.: 598,904

[22] Filed: Oct. 16, 1990

[51] Int. Cl.[5] ..... A47K 3/00

[52] U.S. Cl. ..... 4/559; 4/542; 4/567; 4/577.1; 4/575.1; D23/277

[58] Field of Search ..... 4/538, 541, 559, 584, 4/567, 568, 569, 576, 589, 580; D24/38; D23/277, 280, 281

[56] References Cited

U.S. PATENT DOCUMENTS

| | | | |
|---|---|---|---|
| D. 219,215 | 11/1970 | Korol | D23/281 |
| D. 274,456 | 6/1984 | Cuttriss | D23/280 |
| D. 275,597 | 9/1984 | Lax | D23/280 X |
| 1,339,593 | 5/1920 | Booth | 4/568 |
| 1,677,160 | 7/1928 | Woolfenden | 4/568 |
| 1,947,250 | 2/1934 | Davison et al. | 4/584 |
| 1,953,798 | 4/1934 | Grandcourt | 4/575 |
| 2,198,631 | 4/1940 | More | 4/568 |
| 3,967,323 | 7/1976 | Serio | 4/541 |
| 4,254,516 | 3/1981 | Johansson | 4/559 |
| 4,316,294 | 2/1982 | Baldwin | 4/575 |
| 4,552,658 | 11/1985 | Adcock et al. | 4/542 |
| 4,857,112 | 8/1989 | Franninge | 4/541 |

OTHER PUBLICATIONS

Residential Products Catalog, Eljer, 1979, (first eight pages).

*Primary Examiner*—Daniel M. Yasich

*Attorney, Agent, or Firm*—Blum Kaplan

[57] ABSTRACT

A bathtub assembly having contoured walls and fixtures constructed to fit within or about the walls is provided. The assembly includes a bathtub having at least one wall defining a curved protrusion and a curved recess. A filler spout having a generally shell-shaped configuration is adapted to fit within or above certain of the curved wall portions. One or more grab bars are also designed to fit within the bathtub. The filler spouts and grab bars all present curved interior surfaces which, as strategically mounted within the bathtub, minimize inadvertent contact by a person within or entering the bathtub. A headrest is also provided for attachment to a curved wall of the bathtub. The headrest includes a curved front portion which is secured by suction cups to a wall of the bathtub and an integral rear portion which extends over a deck of the bathtub. A grouping of bathtubs, each having walls of similar or identical curvature are provided so that the same fixtures and accessories can be used in the same manner in more than one bathtub model.

17 Claims, 8 Drawing Sheets

22
30
16
12
10
42
24
42
20
18
14
38
30
52
48
46
44
50
48
52

BATHTUB ASSEMBLY HAVING CONTOURED WALLS AND ACCESSORIES

BACKGROUND OF THE INVENTION

1. Field of the invention.

The field of the invention relates to bathtubs, whirlpools and the like, and fixtures associated therewith.

2. Brief description of the prior art.

Bathtubs have traditionally been constructed to include substantially elongate reservoirs defined by substantially straight side walls and curved or straight end walls. U.S. Pat. Nos. 1,953,798 and 2,242,461 disclose bathtubs having these general configurations. The fixtures associated with these bathtubs, such as filler spouts, grab bars or rails, are located without particular regard to the walls and decks thereof. The filler spout is typically located at one end of the bathtub while a grab bar or rail is located near the center thereof. The grip or rail is also typically affixed to the bathroom wall adjoining one of the straight walls of the bathtub, and is accordingly difficult to use upon entering or exiting the tub.

A second drawback of most grab bars and water spouts is that they generally project perpendicularly from a bathroom wall or a wall of the tub and form obstructions which must be avoided by persons who use the tub. This is both a slight hazard and an inconvenience. The benefits of grab bars greatly exceed their drawbacks, however.

Bathtubs and the like are also known to include curved walls for both functional and aesthetic purposes. U.S. Pat. Nos. 4,316,294 and 264,628 disclose two such structures. The fixtures, if any, associated with these structures, simply project straight into or over the area of the tub, and are not constructed to make use of the curved walls thereof.

Head and back rests are useful articles which have been employed within bathtubs and the like. U.S. Pat. Nos. 1,953,798 and 3,078,474 disclose two such articles, each of which is secured to a rounded end wall of a bathtub. Suction cups are used to secure the articles to the end walls. None of the articles shown includes a section which is adapted for resting upon the deck portion of a bathtub, however. Excessive pressure upon the top of the articles may accordingly cause them to slide down the wall of the bathtub.

SUMMARY OF THE INVENTION

It is an object of the invention to provide a bathtub assembly including a plurality of curved walls and fixtures having curved surfaces which correspond to the walls of the bathtub.

It is another object of the invention to provide a bathtub assembly having accessories which are configured to correspond to the bathtub walls.

A still further object of the invention is to provide a grouping of bathtubs, fixtures and/or accessories, all of which include curved surfaces, the fixtures including curved surfaces which correspond to the curved surfaces of each of the bathtubs.

A still further object of the invention is to provide a bathtub accessory in the form of a headrest which provides comfort and protection both inside the bathtub and above the deck of the bathtub.

In accordance with these and other objects of the invention, a bathtub assembly is provided which includes a bathtub, the bathtub including a plurality of curved walls having curved surface portions defining a reservoir, a deck surrounding all or part of the reservoir, and a filler spout mounted to the bathtub, the filler spout comprising a body portion preferably having a generally shell-shaped configuration, the body portion preferably including a curved front surface extending into the reservoir and aligned with one of the curved surface portions of the bathtub walls. This arrangement minimizes the obstructiveness of the filler spout.

A grab bar having a curved surface may be provided within the bathtub. The grab bar may be mounted to the curved walls of the tub, or the deck and one of the curved walls. In either case, it has a curved configuration which reduces the possibility of a person being injured by it.

A headrest is also preferably mounted to one of the bathtub walls. The headrest includes a curved front portion which is secured to a bathtub wall and a rear portion which extends over the deck. Suction cups or the like may be employed for securing the headrest to the bathtub.

A grouping of bathtubs, fixtures and accessories which may be combined to provide any number of coordinated bathtub assemblies is also provided by the invention. Each bathtub within the group includes at least three curved walls which, either alone or together with a fourth wall, define a reservoir. A substantially horizontal deck adjoins each of the curved walls. A plurality of filler spouts are provided, each of which includes a curved rear surface which substantially corresponds to a curved wall of each of the bathtubs so that it can form a flush fit therewith. A plurality of grab bars are provided, each of which has a curved configuration and an end portion adapted to form a substantially flush fit with one of the walls of each bathtub. Finally, a headrest is provided which is contoured to provide a flush fit against one or more of the curved walls of each of the bathtubs.

DETAILED DESCRIPTION OF THE INVENTION

Figure 1:
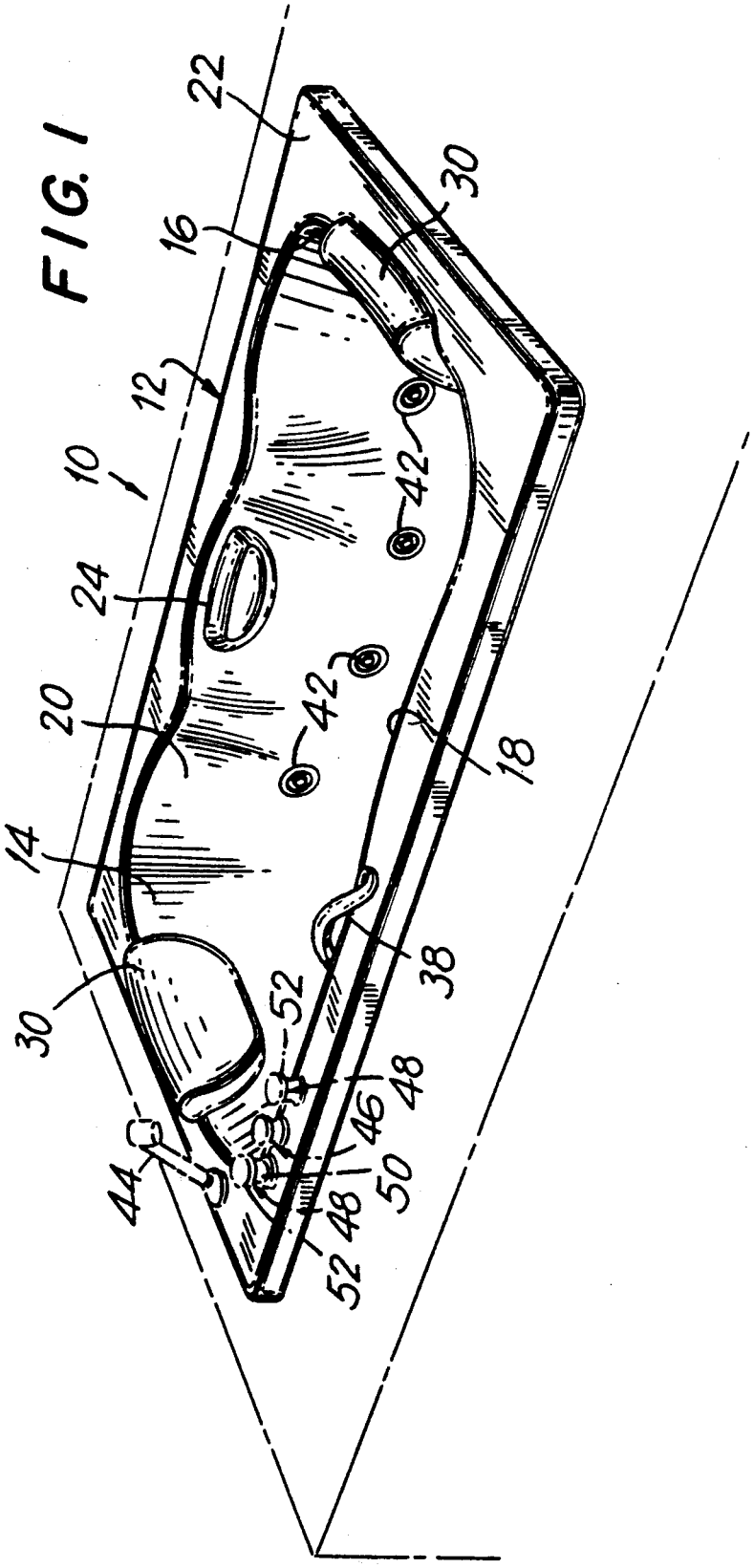
FIG. 1 is a top perspective view of a first bathtub assembly in accordance with the invention.
Figure 2:
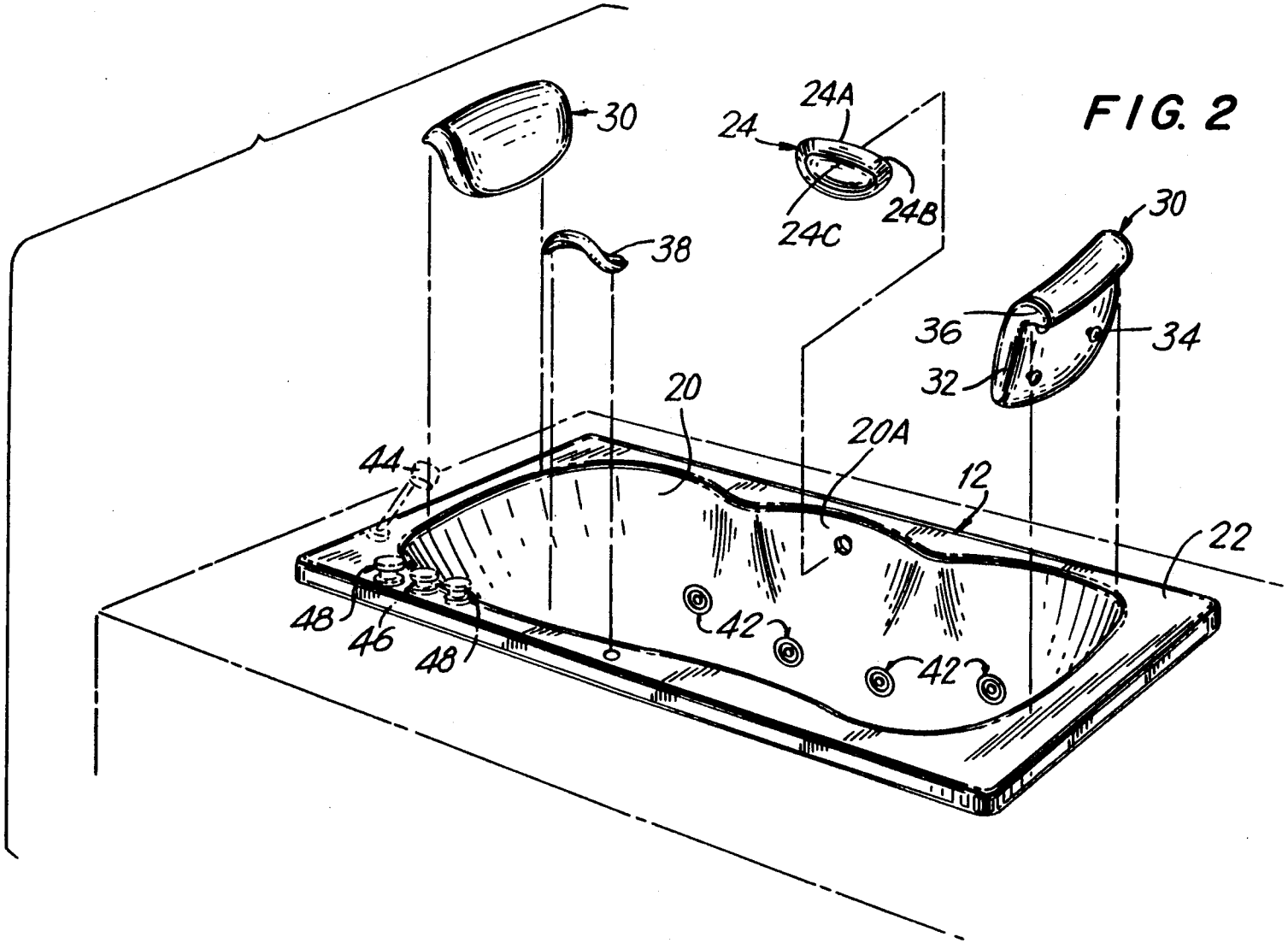
FIG. 2 is an exploded, perspective view thereof.
Figure 3:
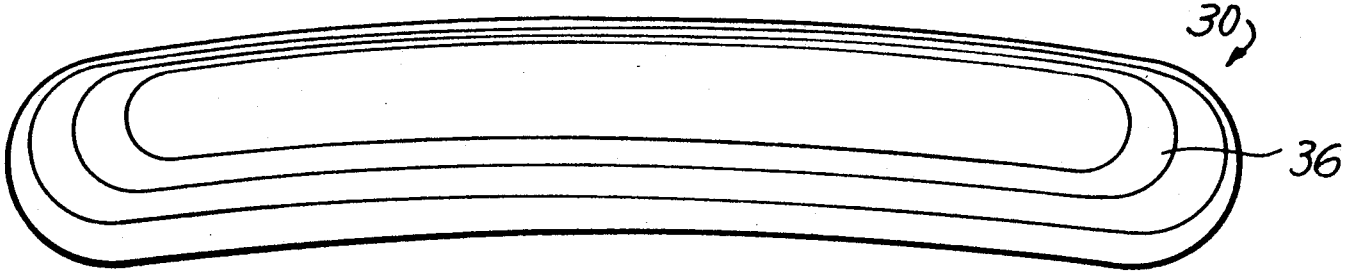
FIG. 3 is a rear end view of a headrest employed within the bathtub assembly of FIG. 1.

A bathtub assembly 10 as shown in FIGS. 1-2 includes a bathtub 12 and various fixtures and accessories.

The bathtub 12 includes a curved front wall 14, a curved rear wall 16, a first side wall 18 having a wave-like interior surface, and a second side wall 20 including a plurality of curved interior surfaces. A deck 22 is formed integrally with the bathtub walls, and extends horizontally from each of the walls defining the reservoir of the bathtub. At least one of the side walls has a steep interior surface in order to facilitate access to the bathtub.

A filler spout 24 is secured to one of the side walls 20 of the bathtub. The filler spout 24 includes a rear surface 24A which conforms to the curvature of the side wall, and is accordingly seated flushly against the side wall. Since the side wall is recessed at the curved portion 20A to which the filler spout is mounted, the spout is only minimally obstructive. The top and front surfaces 24B, 24C of the filler spout are also rounded, which creates a shell-like configuration. These curved surfaces also minimize the possibility of injury should a person inadvertently strike them. The curved front surface of the filler spout also corresponds to the general contour of the side wall 20, particularly with respect to the curved, protruding portions which adjoin it. The bottom surface of the filler spout includes a plurality of openings (not shown) for emitting water. The rear surface 24A of the filler spout includes an opening (not shown) for admitting water.

Figure 4:
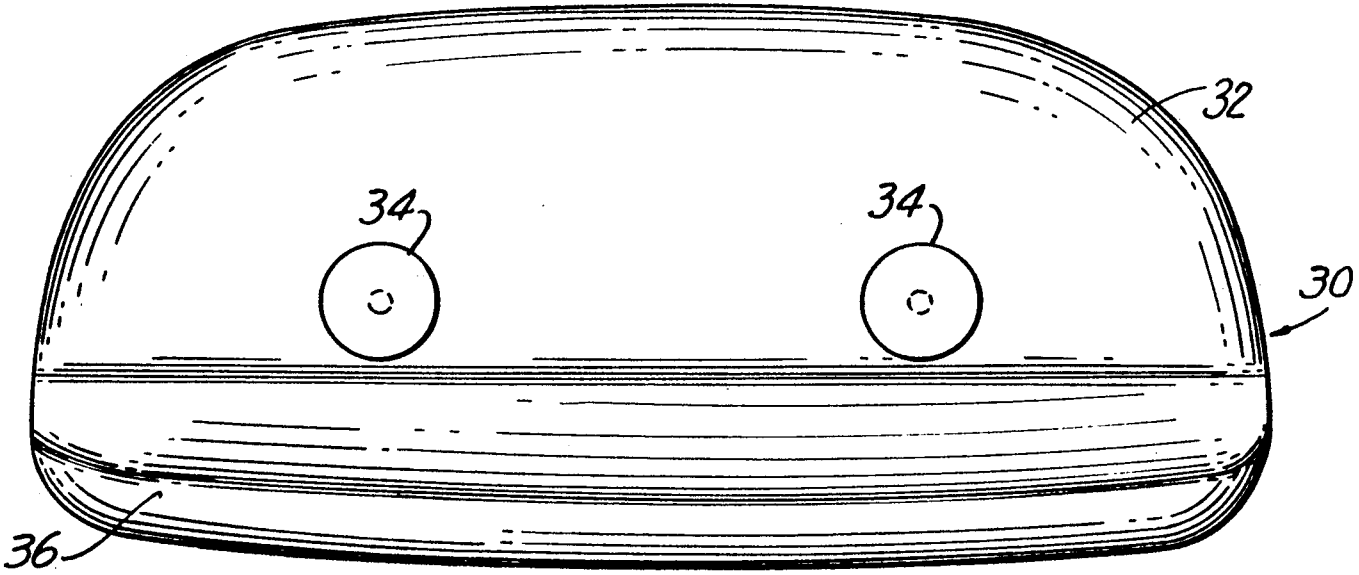
FIG. 4 is a bottom plan view thereof.

A pair of headrests 30 is secured to the opposing front and rear walls of the bathtub. Each headrest includes a curved front portion 32 which is secured by suction cups 34 (FIGS. 2, 4) or the like to a wall of the bathtub. An integral rear portion 36 of each headrest 30 extends over the deck 22 of the bathtub, thereby providing extra protection and comfort for the user as well as helping to prevent the headrest from sliding down the wall of the bathtub.

Figure 5:
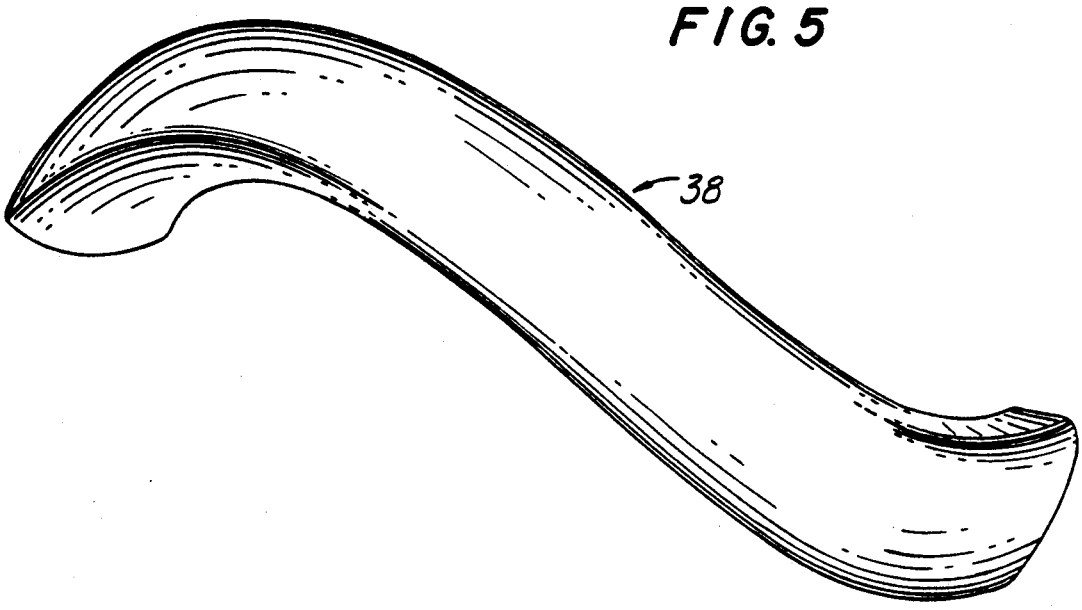
FIG. 5 is an enlarged elevation view of a grab bar employed within the bath tub assembly of FIG. 1.
Figure 6:
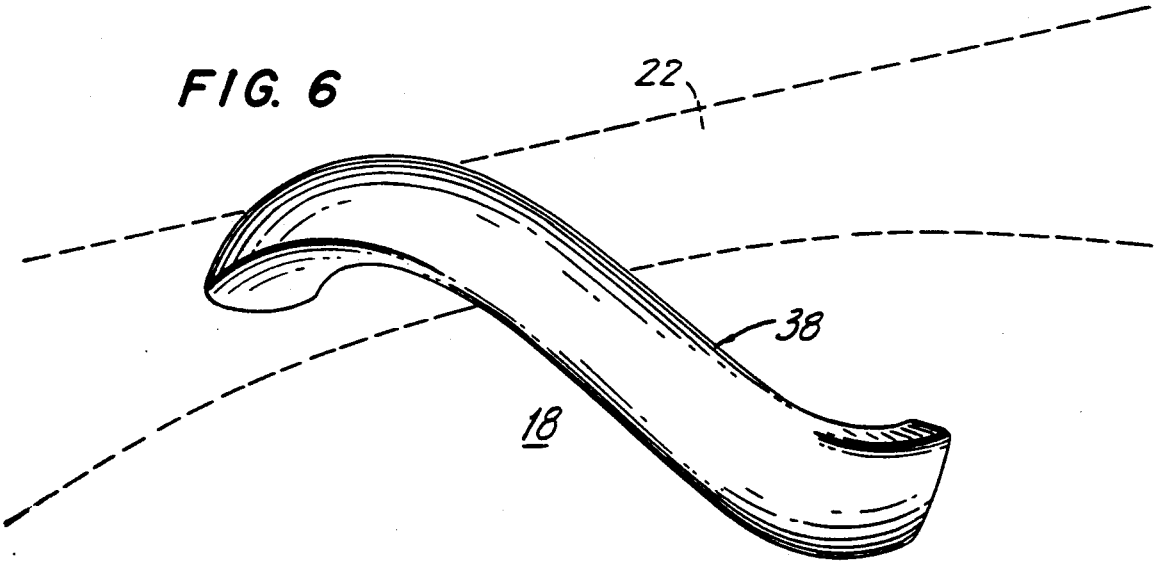
FIG. 6 is an elevation view thereof showing the deck of the bathtub in broken lines.

A spiral-shaped grab bar 38, as shown in FIGS. 5–6, is secured between the deck 22 and a side wall 18 of the bathtub 12. The grab bar is substantially oval in cross section to permit easy gripping by a user. Like the filler spout, it provides a curved surface which will not tend to cause injury if accidentally struck by a user. It is also more difficult to strike with anything other than a glancing blow than conventional grab bars.

Figure 7:
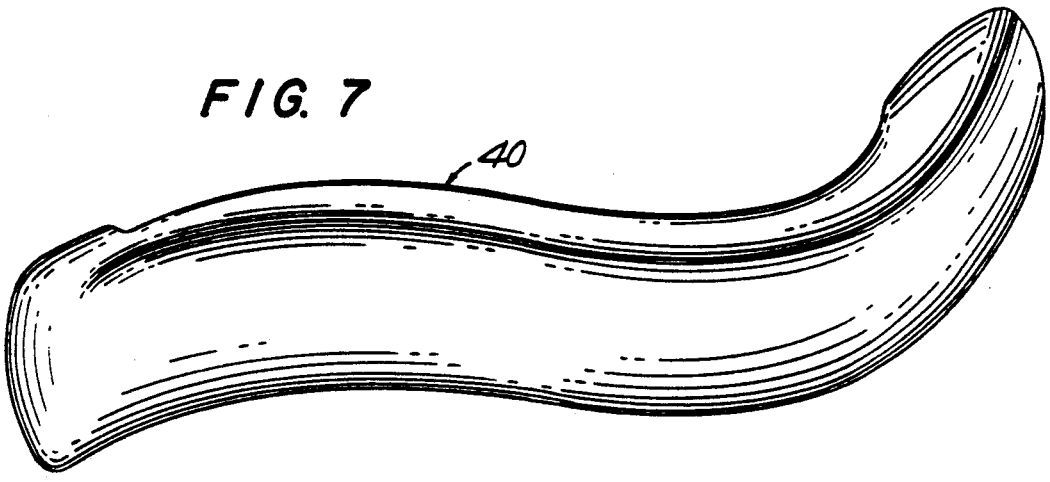
FIG. 7 is a top perspective view of an alternative grab bar which may be used in accordance with the invention.
Figure 8:
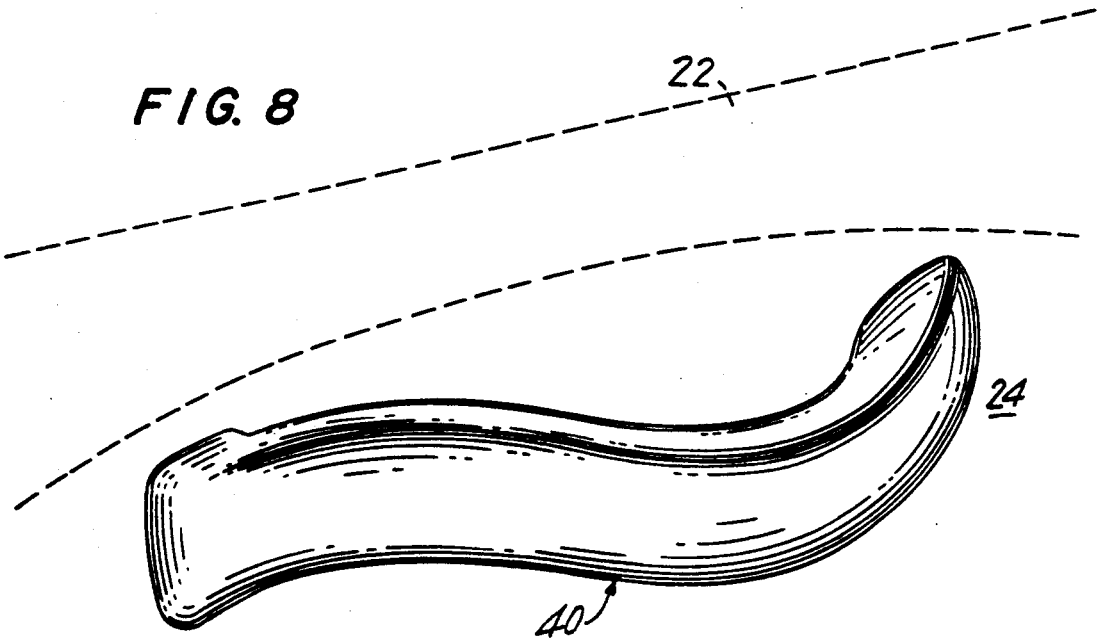
FIG. 8 is a top perspective view thereof showing the grab bar secured to the side wall of a bathtub.

An alternative, wave-like grab bar 40, shown in FIGS. 7–8, may be employed instead of or in addition to the grab bar shown in FIGS. 5–6. The grab bar is secured at each end to a side wall of the bathtub. It is preferably secured in opposing relation to an outwardly curving (recessed) portion of the side wall, as shown in FIG. 8, to provide plenty of room for a person's fingers to fit between the side wall and the grab bar. The curvature of the grab bar 40 and its position with respect to the side wall prevent most inadvertent contact therewith. Any accidental contact will be unlikely to result in injury since no sharp corners or unnecessary protruding surfaces are present.

A plurality of air jets 42 may be provided in a side wall of the bathtub so that it may be used as a whirlpool. A shower attachment 44 is also mounted to the deck 22 of the bathtub. A first knob 46, also extending from the deck, controls whether water will flow from the shower attachment 44 or the filler spout 24. Two additional knob assemblies 48 control the flow rates of hot and cold water. Each knob includes a cylindrical stem 50 which is eccentrically secured to an ovular handle portion 52. This arrangement facilitates the turning of the knob assemblies as compared to concentrically mounted arrangements.

Figure 9:
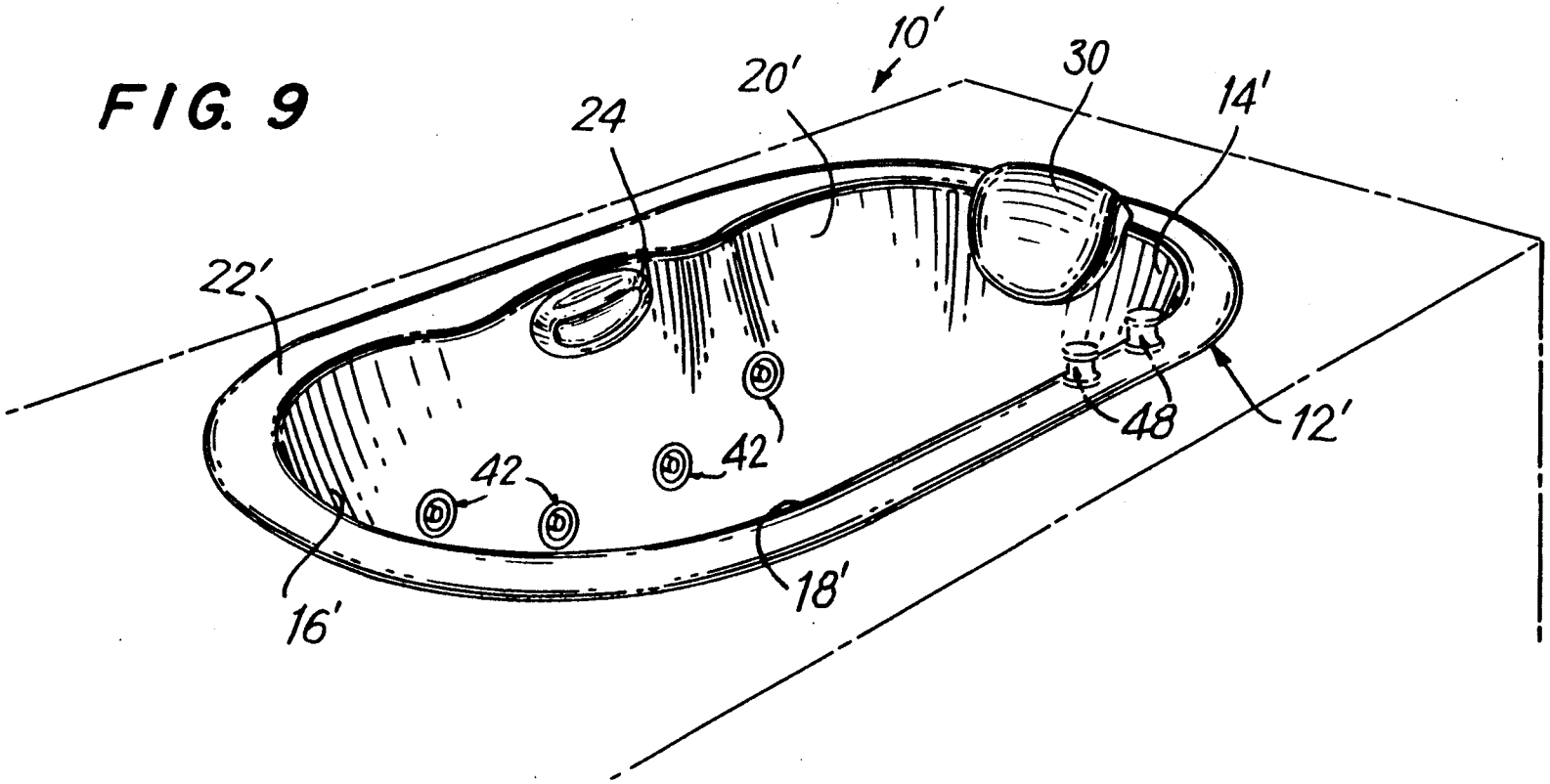
FIG. 9 is a top perspective view of a second bathtub assembly in accordance with the invention.

FIG. 9 illustrates a bathtub assembly 10' according to a second embodiment of the invention. This assembly includes a bathtub 12' having curved front and rear walls 14', 16', a straight side wall 18', and a wave-like side wall 20' including a plurality of curved surfaces. A deck 22' extends horizontally from these walls. A filler spout 24 is mounted to a recessed portion of the wave-like side wall 20' in the same manner as that shown in FIG. 1. A headrest 30 is secured to the front wall 14', also in the same manner as in the embodiment shown in FIG. 1. Hot and cold water control knobs 48 are mounted to the deck 22'. Air jets 42 are mounted within one of the side walls 20'.

Figure 10:
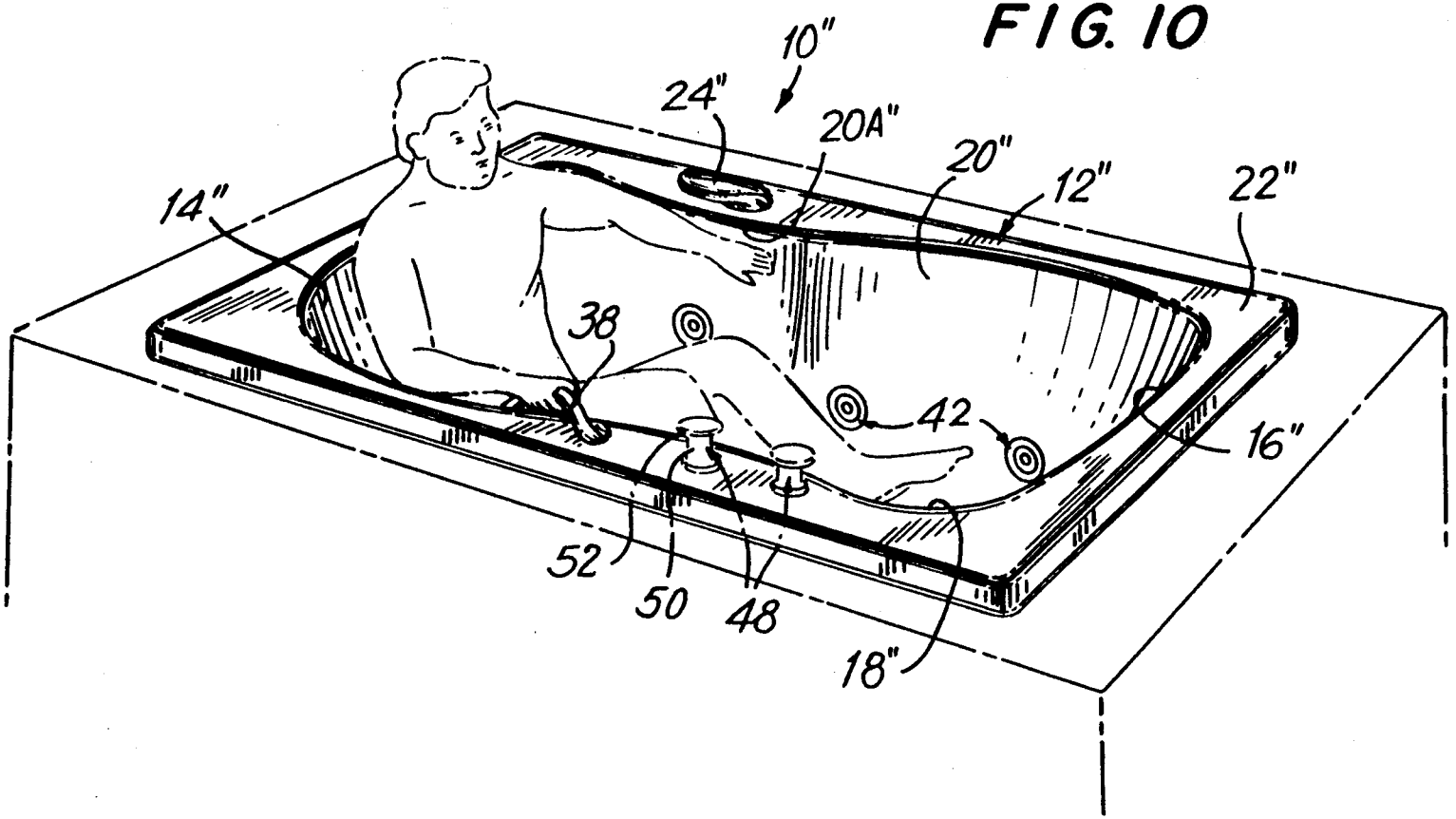
FIG. 10 is a top perspective view of a third bathtub assembly in accordance with the invention.

A third bathtub assembly, 10'' according to the invention is shown in FIG. 10. This assembly includes a bathtub 12'' defined by curved front and rear walls 14'', 16'', a pair of opposing and substantially identical wave-like side walls 18'', 20'', and a horizontally extending deck 22''.

Figure 11:
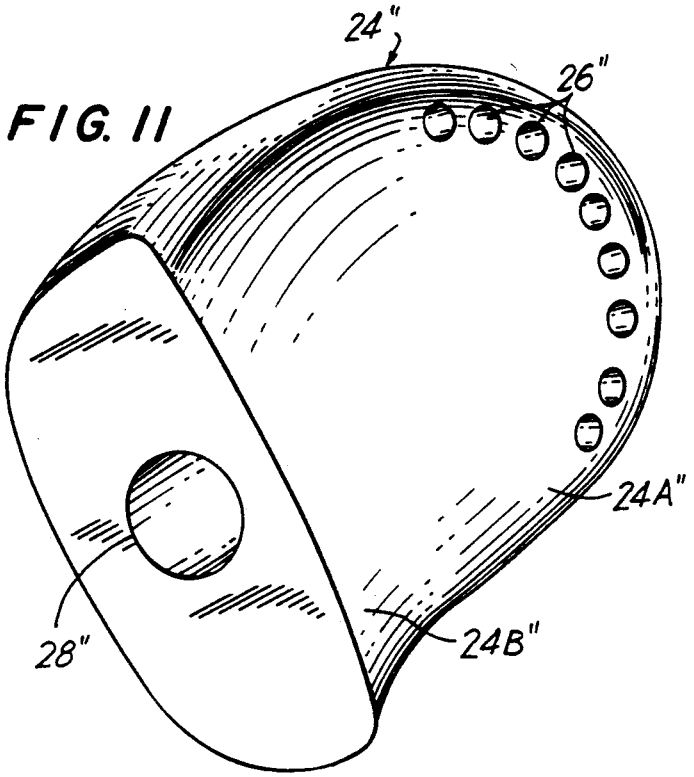
FIG. 11 is a bottom perspective view of a filler spout employed in accordance with the invention.
Figure 12:
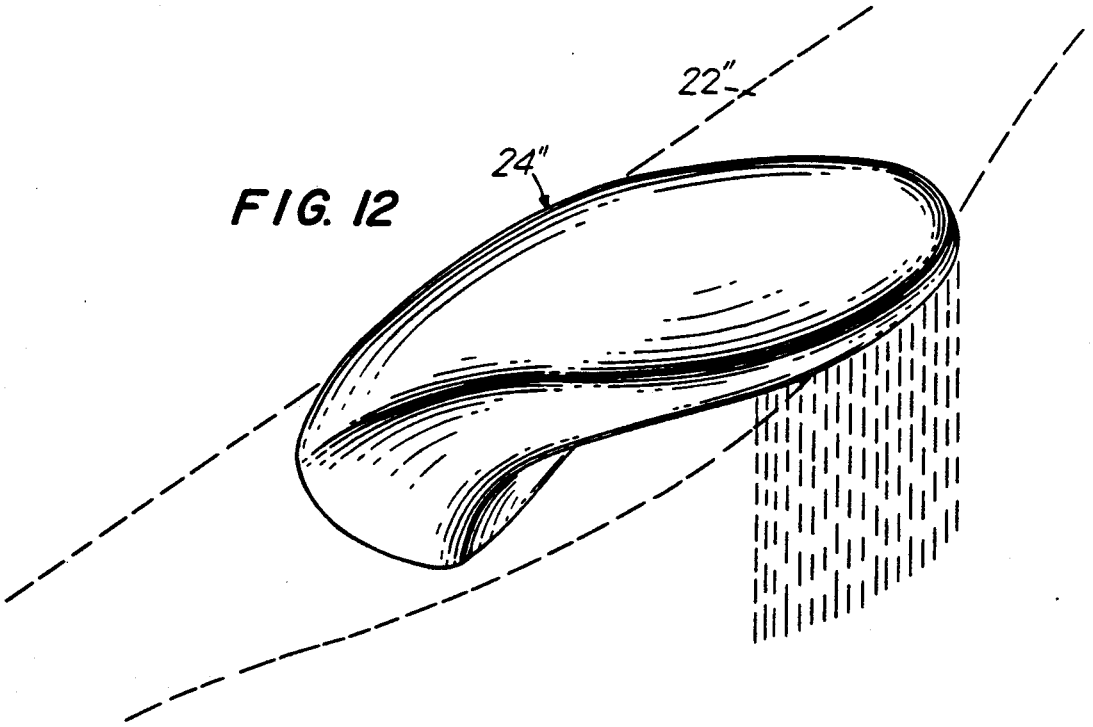
FIG. 12 is a top perspective view thereof.

A filler spout 24'', as shown in FIGS. 11–12, is mounted to the deck 22'' and extends over the reservoir of the bathtub. It is mounted over a curved, protruding portion 20A'' of one of the side walls, thereby minimizing the possibility of a person's inadvertently contacting it. The curved configuration of the front end of the filler spout at least generally corresponds to the curvature of the deck and side wall portion 20A'' over which it extends. As shown in FIG. 11, the bottom surface of the front end 24A'' includes a plurality of openings 26'' for emitting water. The bottom surface of the base 24B'' of the filler spout includes an opening 28'' for admitting water.

It will be appreciated that the bathtub assemblies according to the invention may be constructed with curved side walls of various configuration which allow the strategic placement of the filler spouts and grab bars. The presence of multiple curved surfaces therein is important to the placement of such items. They also provide relatively thin deck portions which allow ease of access. While the illustrated embodiments of the invention all include four walls, it will be appreciated that the principles of the invention would apply to bathtubs having only three walls, or more than four walls as well. The various bathtubs should have at least some walls of common curvature, such as walls 20 and 20' in FIGS. 1 and 9, or walls 18 and 18'' in FIGS. 1 and 10, so that the same fixtures and accessories can be used in more than one bathtub model.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A bathtub assembly comprising:

a first wall, a second wall adjoining said first wall, a third wall adjoining said first wall, said first, second and third walls at least partially defining a reservoir, said first wall defining a curved interior surface;

said second wall defining a plurality of recessed curved interior surfaces, one of said recessed curved interior surfaces including an opening;

a separate filler spout mounted to said second wall in one of said recessed curved interior surfaces at said opening, said filler spout having a generally shell-shaped configuration including a curved surface which at least generally corresponds to said one of said recessed curved interior surfaces of said second wall in which it is mounted;

a deck extending substantially horizontally from at least one of said walls; and a grab bar having a first end secured to said deck and a second end secured to one of said walls, said grab bar having a substantially continuously curved and twisted configuration.

2. A bathtub assembly as described in claim 1 wherein said interior surface of said second wall includes a curved recess, said filler spout including a curved rear end portion seated flushly against said interior surface of said second wall and within said recess.

3. A bathtub assembly as described in claim 2 wherein said filler spout includes a curved front end portion.

4. A bathtub assembly as described in claim 3 wherein said front end portion of said filler spout defines a single curved surface.

5. A bathtub assembly as described in claim 2 including a substantially continuously curved grab bar secured to one of said first, second and third walls.

6. A bathtub assembly comprising:

a first wall, a second wall adjoining said first wall, a third wall adjoining said first wall, said first, second and third walls at least partially defining a reservoir, said first wall defining a curved interior surface, said second wall defining a plurality of curved interior surfaces;

a filler spout mounted to said second wall, said filler spout having a generally shell-shaped configuration including a curved surface which at least generally corresponds to one of said curved interior surfaces of said second wall, said interior surface of said second wall including a curved recess, said filler spout including a curved rear end portion seated flushly against said interior surface of said second wall and within said recess; and a substantially continuously curved grab bar secured to one of said first, second and third walls, said wall to which said grab bar is secured including an indented, curved portion, said grab bar including a pair of end portions secured to said wall such that said grab bar straddles said indented, curved portion of the wall to which it is secured.

7. A bathtub assembly as described in claim 6 including a deck extending substantially horizontally from at least one of said walls.

8. A bathtub assembly as described in claim 7 including a headrest secured to one of said walls, said headrest including a first portion extending within said reservoir and a second, integral portion extending over and contacting said deck.

9. A bathtub assembly as described in claim 7 including a grab bar having a first end secured to said deck and a second end secured to one of said walls, said grab bar having a substantially continuously curved configuration.

10. A bathtub assembly comprising:

a first wall, a second wall adjoining said first wall, a third wall adjoining said first wall, said first, second and third walls at least partially defining a reservoir, said first wall defining a curved interior surface;

said second wall defining a plurality of curved interior surfaces;

a filler spout mounted to said second wall, said filler spout having a generally shell-shaped configuration including a curved surface which at least generally corresponds to one of said curved interior surfaces of said second wall; and a deck extending substantially horizontally from at least one of said walls, said second wall including an inwardly protruding, curved portion, said filler spout being mounted to said deck and extending over said inwardly protruding, curved portion, said filler spout including a curved front end which at least generally corresponds to the curvature of said inwardly protruding, curved portion.

11. A bathtub assembly comprising:

a bathtub including at least first and second adjoining walls bordering a reservoir, said first wall defining a curved interior surface, said second wall defining a substantially continuously curved interior surface including a curved protrusion and a curved recess adjoining said curved protrusion;

said first wall including a first deck portion extending substantially horizontally therefrom;

said second wall including a second deck portion extending substantially horizontally therefrom; and a separate filler spout having a generally shell-shaped configuration mounted to said second deck portion, said filler spout including smoothly contoured surfaces at least generally corresponding to the contour of said interior surface of said second wall, said filler spout extending over said curved protrusion of said second wall, said filler spout including a front end having a curved configuration at least generally corresponding to the curvature of said curved protrusion.

12. A bathtub assembly as described in claim 11 including a third wall adjoining said first wall, said third wall defining a substantially continuously curved interior surface including a curved protrusion and a curved recess adjoining said curved protrusion of said third wall, and a substantially continuously curved grip bar secured to said third wall.

13. A bathtub assembly as described in claim 12 wherein said grip bar spans said curved recess of said third wall.

14. A bathtub assembly as described in claim 12 including a third deck portion extending substantially horizontally from said third wall, said third deck portion including at least one relatively wide portion and at least one relatively thin portion.

15. A bathtub assembly group comprising:

a first bathtub group having a first configuration including a walled reservoir having preselected multi-curved surface portions designed to conform with corresponding multi-curved surface portions on at least a second bathtub group having a second configuration including multi-curved surface portions;

a removable and attachable accessory having a curved surface for mating with common preselected curved surfaces of at least said first and second bathtub groups to facilitate interchangeable use of the accessory with said differently configured bathtubs; and said accessory and said curved surfaces of said bathtubs being shaped and positioned with respect to adjacent predetermined curved surfaces of the bathtubs to minimize the presence of protrusions or obstructions to interfere with the use of the bathtubs and attached accessory.

16. A bathtub assembly group as described in claim 15 wherein said accessory is a filler spout.

17. A bathtub assembly as described in claim 15 wherein said accessory is a grip bar.

* * * * *